US006227438B1

(12) United States Patent
Hiltke

(10) Patent No.: US 6,227,438 B1
(45) Date of Patent: May 8, 2001

(54) EXPANDABLE DEPTH TRAY

(75) Inventor: Eric Hiltke, Bergen, NJ (US)

(73) Assignee: Smurfit Stone Corporation, St. Louis, MO (US)

( * ) Notice: Subject to any disclaimer, the term of this patent is extended or adjusted under 35 U.S.C. 154(b) by 0 days.

(21) Appl. No.: 09/520,888

(22) Filed: Mar. 7, 2000

(51) Int. Cl.[7] ..... B65D 5/32

(52) U.S. Cl. ..... 229/101; 220/8; 229/122.21; 229/164

(58) Field of Search ..... 229/101, 122.21, 229/164; 220/4.03, 8; 211/175; 312/205

(56) References Cited

U.S. PATENT DOCUMENTS

| | | | | |
|---|---|---|---|---|
| 655,939 | * | 8/1900 | Overton | 229/122.21 |
| 874,442 | * | 12/1907 | Sandel | 312/205 |
| 1,120,955 | * | 12/1914 | Martin | 229/122.21 |
| 2,941,670 | * | 6/1960 | Fagan et al. | 229/101 |
| 2,948,624 | * | 8/1960 | Watson et al. | 229/101 |
| 3,193,108 | * | 7/1965 | Johnson | 229/164 |
| 3,463,343 | * | 8/1969 | Asenbauer | 220/8 |
| 3,700,159 | * | 10/1972 | Beigel | 229/101 |
| 4,116,330 | * | 9/1978 | Ellis | 229/164 |
| 4,128,167 | * | 12/1978 | Hogshead, III | 229/164 |
| 5,192,019 | * | 3/1993 | Meehan | 220/8 |

FOREIGN PATENT DOCUMENTS

| | | | | |
|---|---|---|---|---|
| 2646141 | * | 10/1990 | (FR) | 229/101 |

* cited by examiner

*Primary Examiner*—Gary E. Elkins
(74) *Attorney, Agent, or Firm*—Paul M. Denk

(57) ABSTRACT

A paperboard display tray having adjustable depth including an outer tray support with a back wall and a pair of integral side walls having a tapered profile from back wall to the front. The side walls are composed of double walls with a space in between. The display tray also includes a slidable tray section with a bottom wall, a front wall along the front edge of the bottom wall, and a pair of side walls. The side walls of the slidable tray section engage the space in side walls of the outer frame in a sliding engagement and have detents to prevent the slidable tray from disengaging from the outer frame. The overall depth of the display tray can be adjusted by sliding the slidable side walls of the slidable tray section back and forth with the walls of the tray support.

9 Claims, 3 Drawing Sheets

EXPANDABLE DEPTH TRAY

CROSS REFERENCE TO RELATED APPLICATIONS

None

BACKGROUND OF THE INVENTION

This invention relates generally to paperboard trays and more specifically to a paperboard display tray that has expandable depth.

Paperboard or cardboard display trays are known to the art. Generally speaking such trays have a rectangle configuration with a bottom wall, side walls, front wall and back wall. Often, the front wall has a lesser height than the back wall so that access to the tray is facilitated. The back wall can be greater in height and can bear indicia, such as advertisements, prices and the like. As will be appreciated by those skilled in the art, the depth of the tray is dictated by the depth of the bottom wall. These trays generally are erected from a pre-cut paperboard blank. That is, the paperboard blank is precut and then the user or distributor can fold the blank into the tray configuration. The trays can be provided as blanks or as filly erected trays, either full or empty. One particular application for the erected tray is to display for sale small items, such as candy, snacks or other items.

The typical paperboard display tray of the prior art has at least one significant drawback. As set out above, the depth of the tray is dictated by the depth of the bottom wall. Since the bottom wall is provided in the foldable blank, there is no way to vary the depth of the tray. If different size trays are required, different size blanks must be cut, resulting in increased costs, inventory and sometimes waste. Often, as items displayed in a tray are removed and sold, the remaining items can look picked-through or less desirable when they are left over in a large display tray. Hence, it would be advantageous to have a paperboard display tray that can be constructed or assembled from pre-cut paperboard blanks which allows the depth of the resulting tray to be adjusted or varied as desired to reduce costs and inventory and provide an aesthetically pleasing display even as items are removed from the tray.

SUMMARY OF THE INVENTION

It is among the various objects of the present invention to provide a paperboard display tray with an adjustable depth.

It is another object of the present invention to provide such a display tray that can be erected from pre-cut paperboard blanks.

Another object of the invention is to provide such a display tray that has an outer tray support and a slidable tray, the slidable tray functioning as the adjustable bottom wall so as to adjust the overall depth of the tray.

Another object of the present invention is to provide such a display tray that is economical to manufacture, easy to construct, durable and serviceable and well suited for its intended purposes.

In accordance with the invention, generally stated, a paperboard display tray having adjustable depth is provided. The display tray includes an tray support which has a back wall and a pair of integral side walls, the side walls having a substantially tapered profile from the back wall to the front. The side walls are composed of double walls with a space in-between. The display tray also includes a slidable tray section including a bottom wall, a front wall along the front edge of the bottom wall, and a pair of side walls. The side walls of the slidable tray section are disposed to seat in the space in side walls of the tray support in a sliding engagement so that the overall depth of the display tray can be adjusted by sliding the side walls of the slidable tray section into and out of the walls of the tray support. The side walls of the slidable tray section have detent fins at the upper rear edge to prevent the slidable tray from being pulled out of the tray support. The bottom wall of the slidable tray slides on top of the bottom wall of the tray support.

BRIEF DESCRIPTION OF THE DRAWINGS

Corresponding reference numerals indicate corresponding elements throughout the various drawings.

DETAILED DESCRIPTION OF THE INVENTION

Figure 1:
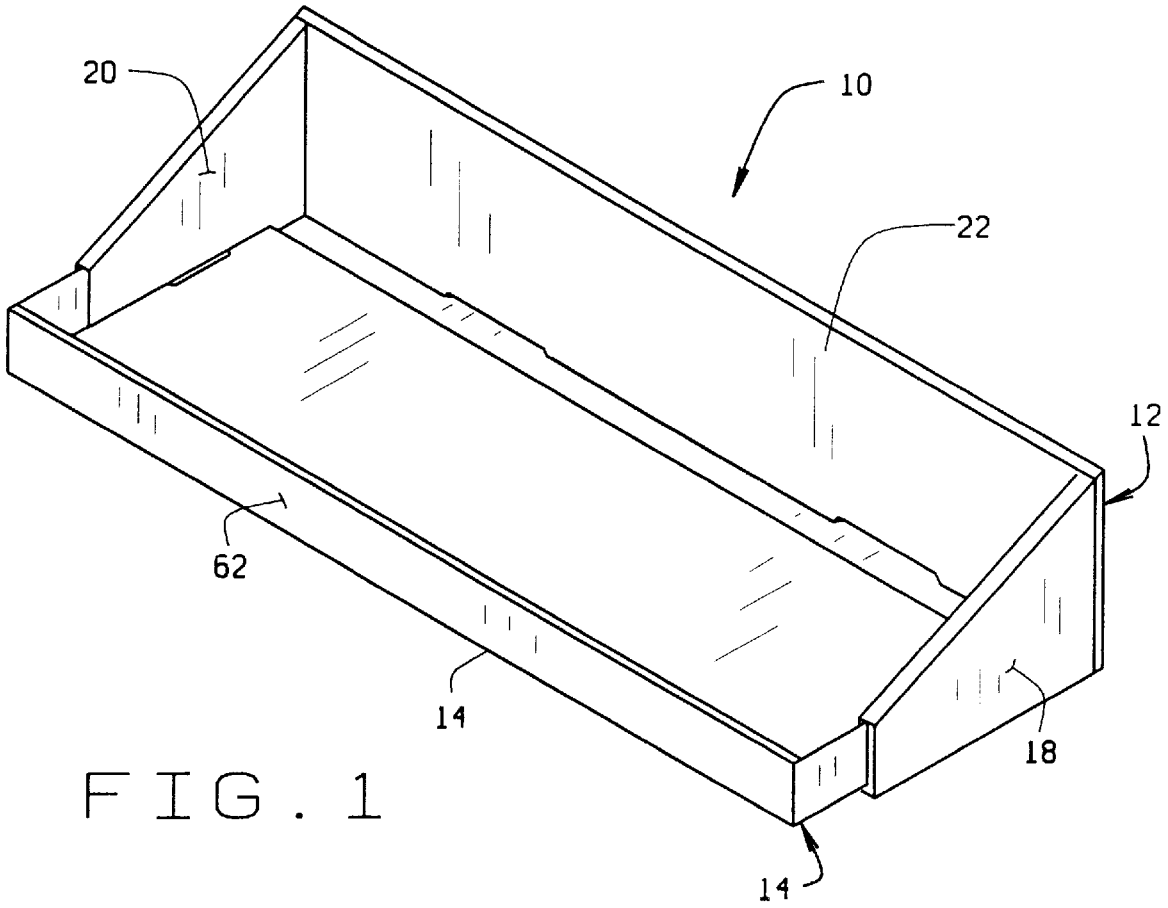
FIG. 1 is a perspective view of the adjustable depth paperboard display tray of the present invention.

A novel adjustable depth paperboard display tray of the present invention is indicated generally by reference numeral 10 in the drawings. It will be appreciated that display tray 10 includes an tray support 12 and a slidable tray 14 slidably engaged in the tray support. The tray support 12 and the slidable tray 14 now will be described in greater detail.

Figure 2:
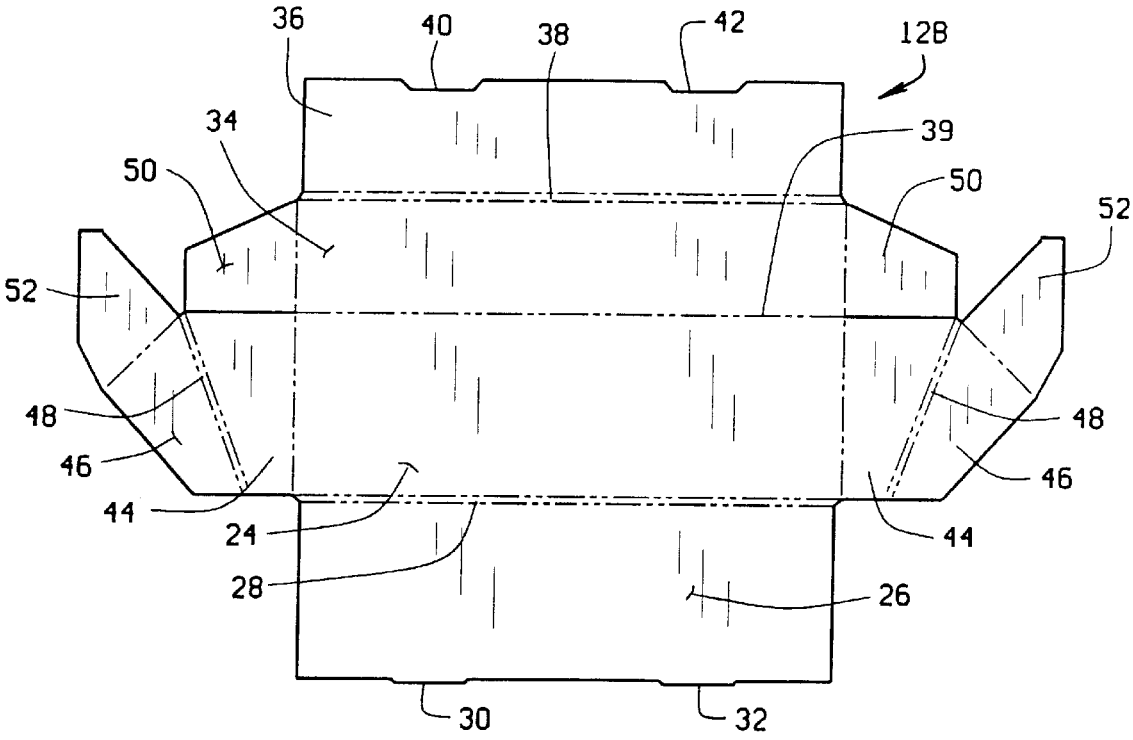
FIG. 2 is a top plan of the paperboard blank which folds into the tray support of the paperboard display tray of the present invention.
Figure 3:
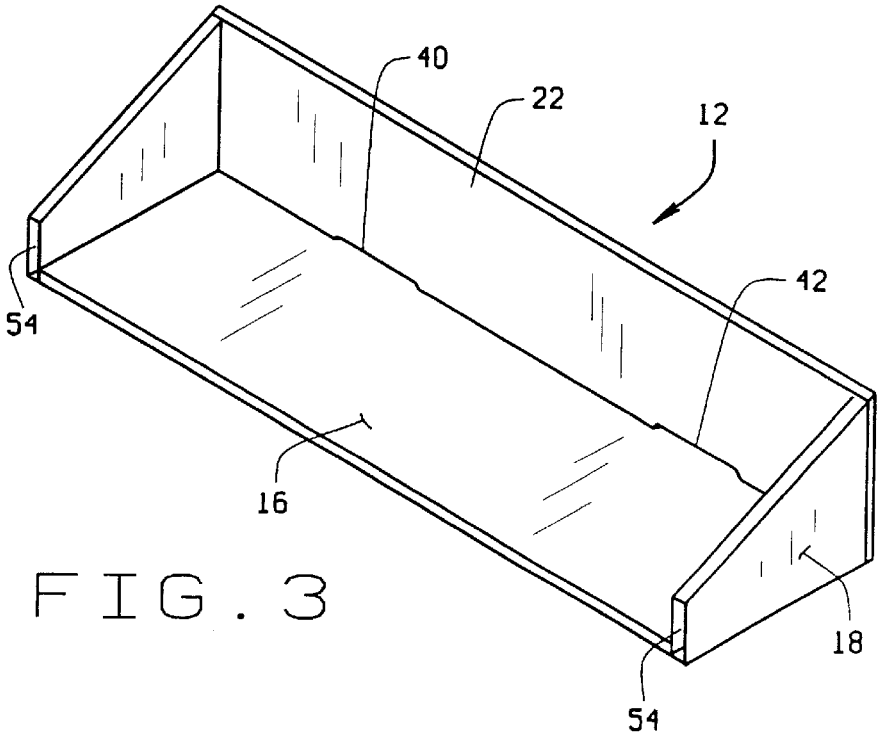
FIG. 3 is a perspective view of the tray support of the paperboard display tray of the present invention folded into its useful configuration.

The tray support 12, as best seen in FIGS. 2 and 3, is erected from a pre-cut paperboard blank, indicated by reference numeral 12B in FIG. 2. Viewing the assembled tray support 12 the tray support has a bottom wall 16, side walls 18 and 20 and a rear or back wall 22. In the illustrated embodiment, side walls 18 and 20 have a generally angled or tapered profile, decreasing in height from the back, where they adjoin the back wall to the front edge. Turning now to the blank 12B, it will be appreciated that the bottom wall 16 is formed from a bottom wall base segment 24 and a bottom wall top segment 26 joined at a double fold line 28. The top segment 26 includes first and second tuck tabs 30 and 32, respectively. As can be appreciated, top segment 26 is folded onto bottom segment 24 and secured with the tuck tabs 30 and 32, as now will be explained. Back wall 22 is formed from outer back wall segment 34 and inner back wall segment 36 joined by a double fold line 38. Outer back wall segment 34 is joined to the bottom wall base segment along fold line 39. Inner back wall segment 36 includes cut outs 40 and 42. When inner back wall segment 36 is folded over outer back wall segment 34, tuck tabs 30 and 32 are inserted into the cut outs 40 and 42, respectively.

Figure 6:
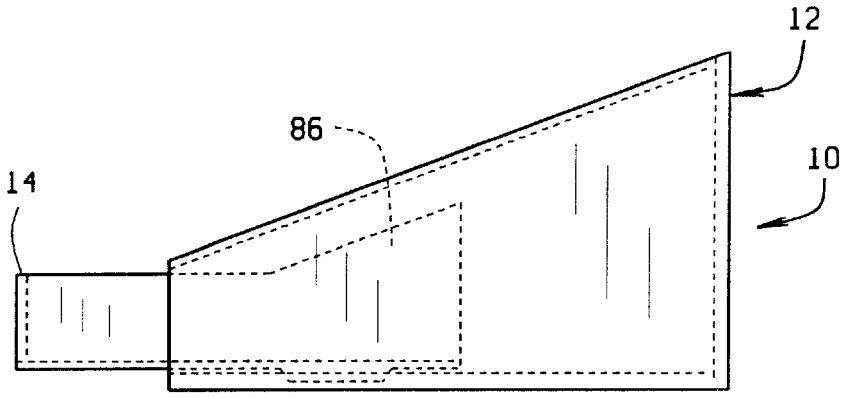
FIG. 6 is a side elevational view of the paperboard display tray of the present invention folded into its useful configuration, showing the sliding relationship between the slidable tray and the tray support.

Side walls 18 and 20 are mirror images and identical in construction. Each side wall includes an outer side wall segment 44 and an inner side wall segment 46 joined by a double fold line 48. The end walls also include a fold support segment 50 and a locking tab 52. Upon assembly, fold support segment 50 is folded in, locking tab 52 folded in over segment 50 and inner side wall segment 46 folded over both. It will be appreciated that because fold line 48 is a double fold line, there is a space, as a 54 in FIG. 3, in between the inner and outer side wall segments. Space 54 is designed to engage the side walls of the slidable tray 14, as shown in FIG. 6. Hence, although the assembly of the outer tray support has been described, it will be appreciated by those skilled in the art, that the slidable tray 14 should be assembled first and the side walls of that section positioned between the inner and outer side walls of the tray support prior to final assembly of the tray support. The elements of the slidable tray 14 will now be described in detail.

Figure 4:
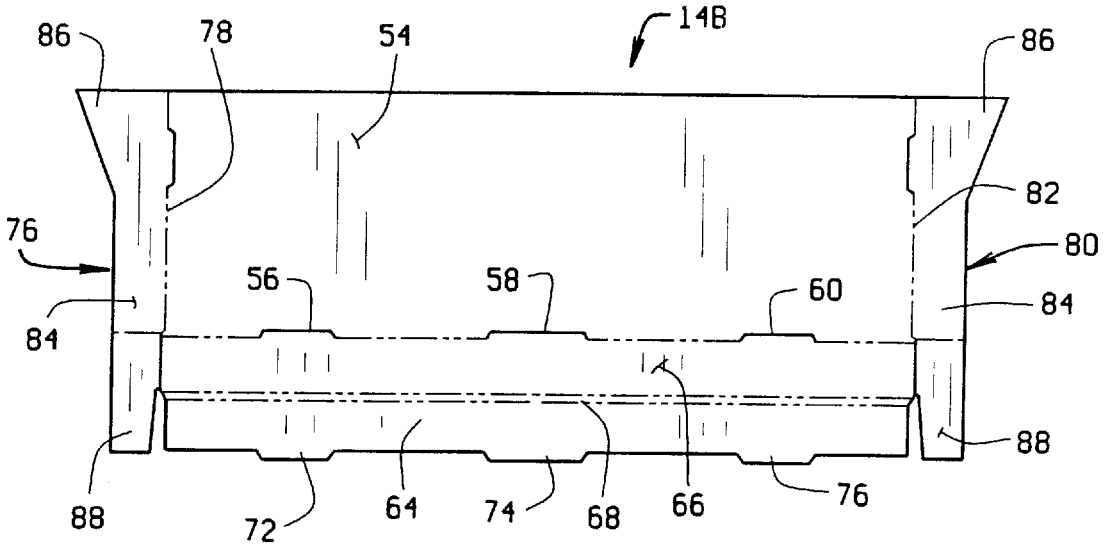
FIG. 4 is a top plan of the paperboard blank which folds into the slidable tray of the paperboard display tray of the present invention.
Figure 5:
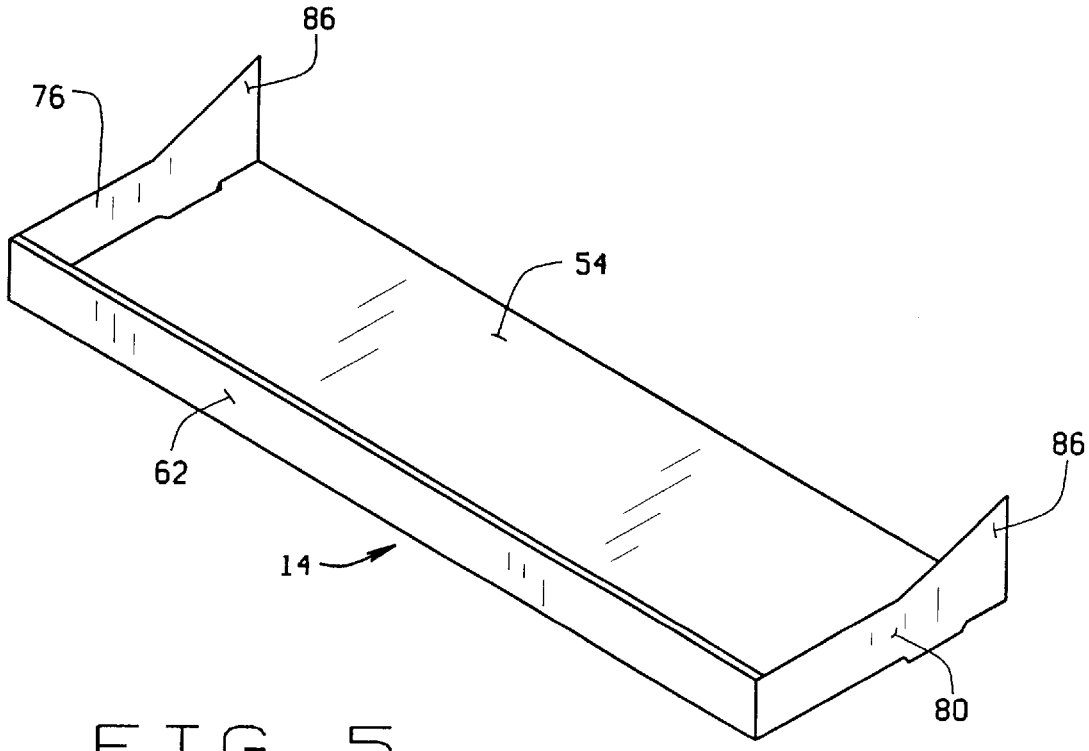
FIG. 5 is a perspective view of slidable tray of the paperboard display tray of the present invention folded into its useful configuration.

Slidable tray 14 and the pre-cut paperboard blank 14B from which it is assembled are shown in greater detail in FIGS. 4 and 5. Slidable tray 14 has a bottom wall 54. Bottom wall 54 has a plurality of cut-outs 56, 58 and 60 spaced along the front edge. The slidable tray has a front wall 62 erected from an inner front wall segment 64 and an outer front wall segment 66 joined by a double fold line 68. Inner front wall segment 64 includes a plurality of locking tabs 70, 72 and 74 spaced along its outer edge positioned to engage cut-outs 56, 58 and 60, respectively, when the walls are folded into their useful configuration along double fold line 68. The slidable tray 14 includes a first side wall 76 connected to the bottom wall 54 by fold line 78 and a second side wall 80 connected to the bottom wall 54 by fold line 82. Side walls 76 and 80 are mirror images of each other and include a main wall segment 84 with a detent fin 86 at the back end and a locking tab 88 at the front end. It will be appreciated that the locking tabs 88 are folded inwardly and secured between the inner front wall segment and outer front wall segment when these front wall segments are folded into their useful configuration along double fold line 68.

As can be seen in FIG. 6 each detent fin 86 has the same general profile as the side walls of the tray support. When the walls of the tray support are erected, the walls 76 and 80 of the slidable tray should be positioned so as to be captured within the spaces 54. It will be appreciated that the detent fins 86 retain the slidable tray within the tray support and prevent the tray from being pulled out of the front of the tray support. However, the slidable tray can be urged back, with the slidable tray walls 76 and 80 slidingly engaged within the spaces 54, to vary the depth of the display tray 10, as desired.

It will be appreciated by those skilled in the art that various changes and modifications can be made in the invention within the scope of the appended claims. Therefore, the foregoing description and accompanying drawings are intended to be illustrative only and should not be construed in a limiting sense.

What is claimed is:

1. An expandable paperboard display tray having adjustable front-to-back depth comprising:

a tray support, said tray support having a back wall, a first integral side wall and a second integral side wall, each said side walls having an upper edge that tapers downwardly from said back wall toward a front edge, each of said integral side walls comprised of an inner wall and an outer wall defining a space in-between; and a slidable tray, said slidable tray having a bottom wall, a first integral side wall having a detent thereon, a second integral side wall having a detent thereon and an integral front wall, said first integral side wall of said slidable tray being slidably engaged within said space within said first integral side wall of said tray support and said second integral side wall of said slidable tray section being slidably engaged within said space within said second integral side wall of the tray support wherein said aforestated detents cooperate internally with the tapers of each side wall to prevent said slidable tray from becoming disengaged from said tray support.

2. The expandable paperboard tray of claim 1 wherein said detents are fins.

3. The expandable paperboard tray of claim 1 wherein said tray support and said slidable tray are constructed from pre-cut paperboard blanks.

4. The expandable paperboard tray of claim 1 wherein said back wall of said tray support is of a greater height than the front wall of said slidable tray.

5. An expandable paperboard display tray having adjustable front-to-back depth comprising:

a tray support, said tray support having a back wall, a first integral side wall and a second integral side wall each said side wall having an upper edge that tapers downwardly from said back wall to a front edge, each of said integral side walls comprised of an inner wall and an outer wall defining a space in-between; and a slidable tray, said slidable tray having a bottom wall, a first integral side wall having a detent thereon, a second integral side wall having a detent thereon and an integral front wall, each said detent having an upper edge that tapers downwardly from rear to front at an angle of taper the same as an angle of taper of said first and second integral side walls of said tray support;

said first integral side wall of said slidable tray being slidably engaged within said space within said first integral side wall of said tray support and said second integral side wall of said slidable tray section being slidably engaged within said space within said second integral side wall of the tray support wherein said aforestated detents prevent said slidable tray from becoming disengaged from said tray support when said slidable tray is pulled forward within said tray support.

6. The expandable paperboard display tray of claim 5 wherein said slidable tray is constructed from a pre-cut paperboard blank.

7. The expandable paperboard display tray of claim 5 wherein said tray support is constructed from a precut paperboard blank.

8. The expandable paperboard display tray of claim 5 wherein the tapers of the upper edges of said first integral side wall of said tray support and said second integral side wall of said tray support have a slope at an angle the same as the angle of taper of said detents on said first and second integral side walls of said slidable tray.

9. If The expandable paperboard display tray of claim 5 wherein said back wall of said tray support has a greater height than the front wall of said slidable tray.

* * * * *

UNITED STATES PATENT AND TRADEMARK OFFICE

CERTIFICATE OF CORRECTION

PATENT NO. : 6,227,438 B1
DATED : May 8, 2001
INVENTOR(S) : Hiltke, Eric

It is certified that error appears in the above-identified patent and that said Letters Patent is hereby corrected as shown below:

Column 4,
Line 60, delete "If".

Signed and Sealed this

Second Day of April, 2002

*Attest:*

*Attesting Officer*

JAMES E. ROGAN
*Director of the United States Patent and Trademark Office*